US005671951A

United States Patent [19]

Palmiter et al.

[11] Patent Number: 5,671,951

[45] Date of Patent: Sep. 30, 1997

[54] CARRYING CASE HAVING A DETACHABLE CLIP-BOARD

[76] Inventors: Stuart E. Palmiter; Sally Anne Palmiter, both of 920 SE. Morlan, Gresham, Oreg. 97080

[21] Appl. No.: 547,985

[22] Filed: Oct. 25, 1995

[51] Int. Cl.[6] ..... B42D 3/12; B65D 85/28

[52] U.S. Cl. ..... 281/31; 206/214; 206/215; 206/224; 206/371

[58] Field of Search ..... 206/214, 215, 206/224, 232, 278, 371; 281/15.1, 29, 31, 34, 44, 45, 51; 150/117

[56] References Cited

U.S. PATENT DOCUMENTS

| | | | |
|---|---|---|---|
| 1,735,318 | 11/1929 | Huey | 281/45 |
| 2,079,817 | 5/1937 | Schade et al. | 281/31 |
| 2,215,833 | 9/1940 | Large | 281/51 |
| 2,224,350 | 12/1940 | Johnston | 281/31 |
| 3,870,223 | 3/1975 | Wyant . | |
| 4,061,170 | 12/1977 | Marks | 206/278 |
| 4,470,620 | 9/1984 | Gerch . | |
| 4,890,728 | 1/1990 | Grimsley | 206/232 |
| 4,932,520 | 6/1990 | Ciarcia et al. . | |
| 5,020,673 | 6/1991 | Adams | 150/117 |
| 5,174,607 | 12/1992 | Hill | 281/45 |
| 5,350,249 | 9/1994 | Peters | 281/31 |
| 5,351,992 | 10/1994 | Chilson et al. . | |
| 5,366,070 | 11/1994 | Wolov | 206/371 |

FOREIGN PATENT DOCUMENTS

| | | | |
|---|---|---|---|
| 2841035 | 4/1980 | Germany | 206/214 |

*Primary Examiner*—Jimmy G. Foster

*Attorney, Agent, or Firm*—Klarquist Sparkman Campbell Leigh & Whinston, LLP

[57] ABSTRACT

A carrying case having a detachable clip-board including a case having a clam-shell configuration and a substantially 290 degree sealable opening, the case including a fastening member for removably attaching the clip-board to an inside surface of the case, the case further including pockets for advantageously storing and providing access to accessory items associated with the use of the clip-board, the case being particularly adapted to withstand harsh environmental and physical conditions such as might be encountered by police when the clip-board is used for writing citations in the field.

14 Claims, 3 Drawing Sheets

CARRYING CASE HAVING A DETACHABLE CLIP-BOARD

BACKGROUND OF THE INVENTION

This invention relates to carrying, holding and protecting a clip-board employing a pad of papers, particularly a clip-board such as those adapted for police use in the writing of citations in the field.

In police work, clip-boards are customarily used by law enforcement officers in the field to write citations, accident reports and the like. A commonly used police clip-board comprises two rectangular metal enclosure members hingedly connected together at one end and having a releasable clasp and spring loaded clasp at the other end. The enclosure members include sides so as to form an enclosure therebetween for enclosing sheets or a pad of paper. The clasp holds the two enclosure members together, yet permits them to swing open for access to the enclosure therein.

Since law enforcement officers in the field are on the move and often do their work in inclement weather, the papers attached to and stored in such a police clip-board are exposed to physical abuse, moisture and staining material such as mud. While the enclosure formed by the two enclosure members provides some protection for papers stored therein, that protection is typically ineffective against moisture, and papers attached to the clip-board by the clip are not protected. Thence, there is a need for a means to carry such a clip-board which better protects the papers yet is sufficiently convenient that it does not hinder a law enforcement officer in the performance of law enforcement duties.

Other types of clip-boards are often used in various situations. For example, clip-boards are often employed within a folder for school use where, generally, a spring biased clip for holding a pad of paper is attached to an inside face of one cover of the folder. The folder employs two hingedly connected covers. Sometimes, one of the covers includes a substantially flat, open pocket for receiving papers. Such pockets are not very suitable for storage of objects that are not flat, such as pads of paper, writing devices or the like. As a partial remedy, a fastenable accessory pouch for pens, pencils, erasers and the like may be installed into such folders employing internal, openable rings for receiving punched paper, such as the well known "three-ring" type binders. Folding devices typically employ covers composed of semi-flexible paperboard (hereinafter "soft"), such as exemplified by Wyant, U.S. Pat. No. 3,870,223, or covers that are substantially rigid (hereinafter "hard"), such as in the aforedescribed "three-ring" type binders. Devices having an integral clip for clipping a pad of paper thereto generally employ a hard cover for providing a surface to support the pad during writing thereon.

The aforementioned devices generally do not employ fastening or retaining means for locking the device in a closed position. Other devices, however, provide this function. For example, Gerch, U.S. Pat. No. 4,470,620 ("Gerch"), proposes a leafed holder wherein a hard leafed member, for providing a writing surface, is selectably closably retainable to a cover.

Gerch, however, is adapted to close into a substantially flat configuration. While Gerch proposes accessory pockets on the cover, only the thickness of a pencil may be accommodated therein. The attempted carrying of objects having any substantial thickness will cause this device to close awkwardly or not at all.

Each of the above devices employs a latch-type retaining mechanism. At least two disadvantages of this type of mechanism are readily apparent. First, the mechanism protrudes from the exterior of the device, so that it may interfere with carrying as well as be inadvertently opened thereby. Second, when employed in conjunction with a pair of hard covers, loose objects therebetween cannot be retained other than by pressure which is exerted by the covers and maintained by the retaining mechanism. Moreover, loose objects simply cannot be retained with this mechanism employed in conjunction with a soft cover.

A serious disadvantage to all of the aforementioned devices is that the contents of the device remain exposed to the elements along edges thereof. Moreover, none of the aforementioned devices is suitable for use under harsh environmental conditions, such as exposure to the elements or to extreme physical abuse.

Of course, common brief cases with zippers around the peripheral edge can be employed to carry papers and protect those papers from inclement weather. Such brief cases often include various pockets therein. However, no such brief case is known which is adapted or adaptable for carrying a police clip-board and facilitating the use thereof by law enforcement officers.

Accordingly, there is a need for a novel carrying case having a detachable clip-board so as to facilitate the carrying, holding and protecting of a clip-board such as a standard police clip-board and accessories associated therewith, wherein the clip-board is portably employed and may be exposed to inclement weather and physical abuse.

SUMMARY OF THE INVENTION

The carrying case having a detachable clip-board of the present invention solves the aforementioned problems and meets the aforementioned needs by employing a case having a clam-shell configuration and having a substantially 290 degree sealable opening between two hingedly connected covers thereof, the case further having two inside surfaces associated with the two covers, the inside surfaces substantially conforming to the size and shape of the clip-board which may be of standard police-issue for writing citations in the field. Preferably, the two covers of the case are soft covers. A fastening member for removable fastening is attached to a first inside surface, while a complementary fastening member is attached to the clip-board, so that the clip-board may be removably attached to the first inside surface of the case. On a second inside surface, a first pocket is provided having a size and shape substantially conforming to the size and shape of a pad of paper for use in the clip-board. The first pocket has an opening adapted for receiving the pad of paper and includes a fastenable cover for retaining the pad of paper inside the cover. Additional pockets also having openings may be attached to the second inside surface for storage of selected other items associated with the employment of the clip-board. The openings of the pockets are advantageously oriented and positioned for easy access thereto.

Therefore, it is a principal object of the present invention to provide a novel carrying case for a detachable clip-board.

It is another object of the present invention to provide such a carrying case that provides for the carrying, holding and protecting of a pre-existing clip-board, such as a standard, police-issue clip-board.

It is still another object of the present invention to provide such a carrying case that provides pockets adapted for advantageously holding and providing access to items associated with the use of the clip-board.

It is yet another object of the present invention to provide such a carrying case that provides for the removable retention of the clip-board by the carrying case.

It is a further object of the present invention to provide such a carrying case that is easily sealed and unsealed yet resists being inadvertent unsealed.

It is still a further object of the present invention to provide such a carrying case that protects the contents thereof from adverse environmental conditions and from physical abuse.

The foregoing and other objects, features and advantages of the present invention will be more readily understood upon consideration of the following detailed description of the invention, taken in conjunction with the following drawings.

DETAILED DESCRIPTION OF A PREFERRED EMBODIMENT

Figure 1A:
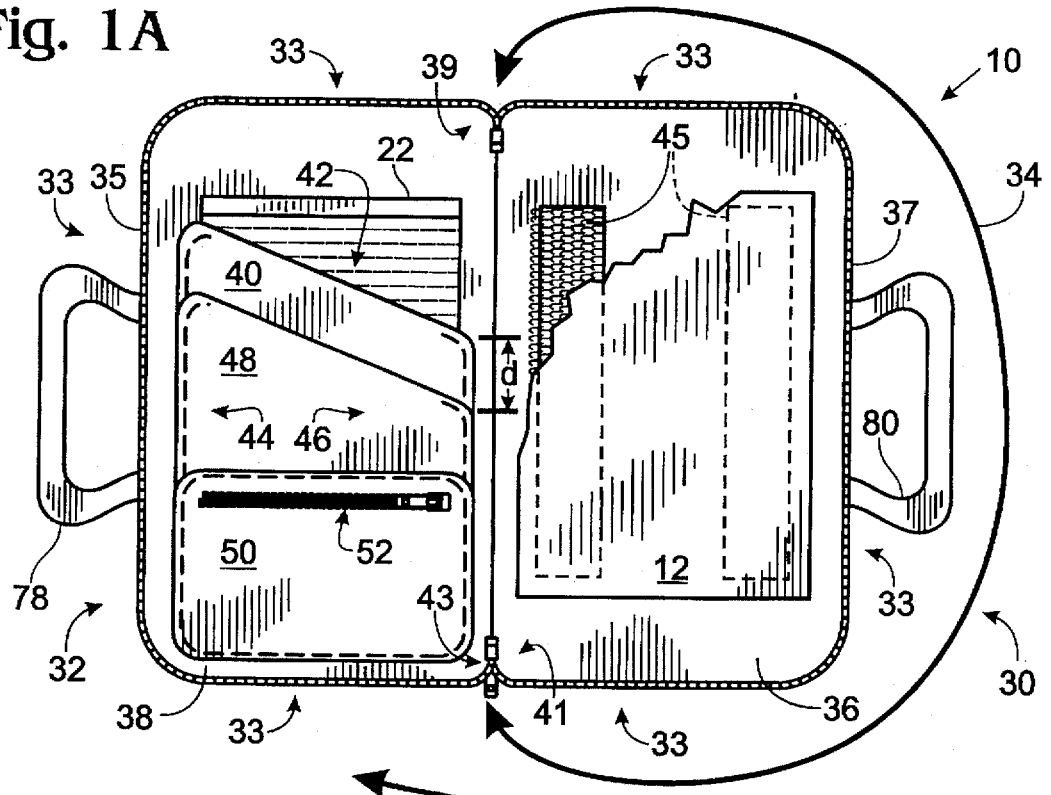
FIG. 1A is a plan view of a carrying case according to the present invention in an open position.

Referring to FIGS. 1A, 1B, 2A and 2B, a carrying case 10 according to the present invention is provided for carrying and protecting a detachable clip-board. Preferably, the case 10 is particularly adapted for use with a clip-board 12, shown in FIGS. 2A and 1B, that is a standard, police-issue clip-board for the writing of citations in the field. Such a clip-board is manufactured by Saunders Manufacturing Company, Inc. in specific geometric configurations and sizes for which the carrying case 10 maybe adapted, as is explained below. The clip-board 12 includes two hingedly connected, spaced-apart sheet metal enclosure members 14, 16 and a spring-loaded clasp 18 disposed on one enclosure member 14 for attachment to the other enclosure member 16 to clasp the two enclosure members together and to maintain them in a closed position. The other of the enclosure members 16 presents, adjacent the top 17 thereof, a spring biased clip 20 for holding one or more sheets or a pad of paper 22. A hinge 23 connects the two enclosure members at the bottom thereof A top surface 19 of the enclosure member 16 provides a backing for writing on the pad 22. The two enclosure members include sides 25 and 27 so that when closed, the two enclosure members form an enclosure 21 for storing a second pad of paper 24 or individual sheets of paper, such as copies of citations.

Fastening members 26, such as the loop portions of a hook and loop releasable fastener, are fixedly attached to a back surface 28 of the frame 14, the hook portion being attached to the carrying case. Of course, the hook and loop portion may be reversed. Moreover, preferably, the fastening members 26 are a hook and loop fastener having substantially about a 1.5 inch width and having an adhesive for applying one portion thereof to the clip-board. Such a fastening member is manufactured by YKK Inc, of Seattle, Wash. under the trademark COSMOLON. However, it is to be recognized that other types of releasable fastening members, such as snaps or buckles may be used without departing from the principles of the invention.

The case 10 is of clam-shell configuration wherein two covers 30, 32 are hingedly connected to one another. The case 10 includes a substantially 290 degree sealable opening 34 between the covers 30 and 32. Opening edges 35, 37, therefore, extend along three sides 33 of each cover and substantially about 1 inch at top 39 and bottom 41 of one edge of each cover to facilitate opening the covers to a wide, open position. The opening 34 is preferably sealed for closing the covers by a zippered fastener 43 attached to the opening edges 35, 37. However, the opening 34 may be sealed by other means capable of closing the cover 30 and the cover 32 along substantially 290 degrees of opening without departing from the principles of the invention.

The covers 30, 32 include inside surfaces 36, 38 respectively, the inside surfaces substantially conforming to the size and shape of the clip-board 12 while leaving sufficient room for storage of paper, writing implements and the like and for clearance. The covers 30, 32 are preferably composed of a 1000 denier nylon or other water and abrasion resistant material such as marketed by Dupont under the trademark CORDURA.

Four standard sized clip-boards have been identified for use with the case 10. A first larger clip-board is substantially 12.5 inches long and 9 inches wide; a first smaller clip-board is substantially 12.38 inches long and 6 inches wide; a second smaller clip-board is substantially 11 inches long and 6 inches wide; and a third smaller clip-board is substantially 10 inches long and 6 inches wide. The clip-boards are manufactured by Saunders Manufacturing Company, part numbers AH 9512; CH 57106; AH 57106; AH 5795 respectively. Preferably, the first clip-board is modified so that its carbon copy plate is removed. The case 10, when in its closed position, must be capable of completely containing the clip-board 12 and providing sufficient clearance for unsealing the opening 34.

Fastening members 45, which are complementary to the fastening members 26 such as the hook portion of a hook and loop fastener, are fixedly attached to the inside surfaces 36 of one of the covers for receiving the fastening members 26 attached to the clip-board 12. The clip-board 12 may thereby be removably attached to the case 10. Preferably, two pairs of hook and loop fastening members are provided in substantially parallel, vertical orientation so that the clip-board can be easily removed by pulling out and down.

On another of the inside surfaces 38, a first pocket 40 is provided having a size sufficient for containing an extra pad 22 for use in the clip-board 12. The first pocket 40 includes an opening 42 that is, preferably, angled with respect to the case 10 so that the pocket 40 is deeper at an outside 44 of the case 10 than at an inside 46. Preferably, in the case of a clip-board 12.38 inches long and 6 inches wide, the pocket is substantially about 8.5 inches deep at one side and about 6 inches deep at the other side.

A second pocket 48 may also be included on the inside surface 38, the second pocket preferably having the same configuration and orientation as the first pocket 40 but lying atop of and translated a distance "d," preferably substantially about 1 inch, downwardly with respect to the first pocket 40.

A third pocket 50 may further be included on the inside surface 38, the third pocket preferably having a substantially rectangular configuration of substantially 5 inches in depth and 8.5 inches in width, the third pocket lying atop of and disposed at a bottom 52 of the inside surface 38. The third pocket 50 preferably includes a means for closure, such as by zippered opening 52. However, it may be closed by other means, such as by a hook and loop fastener, without departing from the principle of the invention.

The aforedescribed first, second and third pockets are preferably employed with the larger case 10, for holding the larger clip-board 12.

Figure 3A:
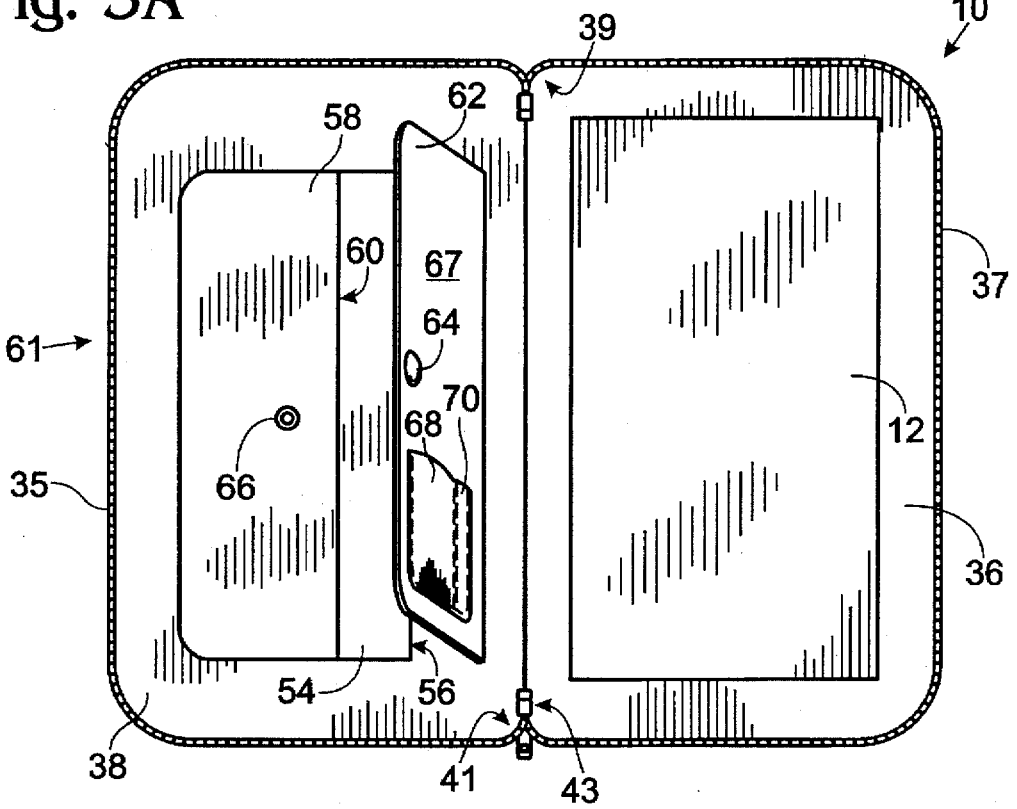
FIG. 3A is a plan view of an alternative carrying case according to the present invention in an open position with a flap open.
Figure 3B:
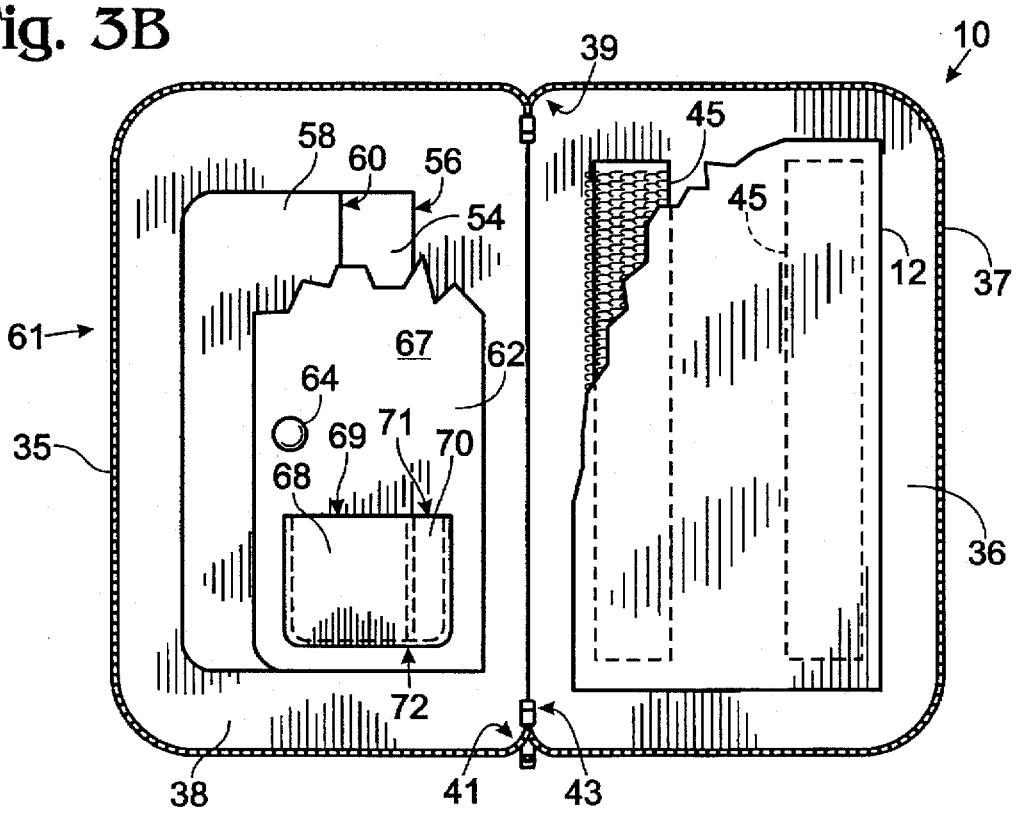
FIG. 3B is a plan view of the carrying case of FIG. 3A with the flap closed.

Referring to FIGS. 3A and 3B, a smaller case 10 is preferably configured for the three aforementioned smaller sizes. The smaller case comprises a first pocket 54 which is substantially rectangular, preferably being substantially about 9.5 inches wide and 4.5 inches deep. The pocket 54 includes an opening 56 along the elongate dimension of the pocket, the opening facing the other inside surface 36.

The smaller case 10 also includes a second pocket 58 disposed atop the first pocket 54, the second pocket also being substantially rectangular; preferably about 9.5 inches wide and 3.5 inches deep. The second pocket 58 also includes an opening 60 along the elongate dimension of the pocket, the opening facing the other inside surface 36 and being disposed outwardly of the opening 56 of the first pocket 54 toward side 61.

The smaller case 10 may also include a flap 62 having a fastening member 64 for removable attachment to the outermost pocket 54 or 58. The outermost pocket 54 or 58, then, includes a fastening member 66 which is complementary to the fastening member 64, so that the flap 62 may be employed to removably cover and hold secure the contents of the pockets 54 and 58.

The flap 62 may further include a small pocket 68 for holding business cards and the like, attached at an outer surface 67 thereof, and a smaller pocket 70 adapted for holding a writing implement. Pockets 68 and 70 have openings 69 and 71 at the top thereof, respectively. Preferably, the pockets 68 and 70 are formed of one sheet of material and are compartmentalized advantageously by simply stitching there across at location 72.

The pockets 40, 48, 50, 54, 58, 68, 70 and the flap 62 are preferably composed of the material of which the covers 30, 32 are composed and are joined to the covers 30, 32 by stitching.

Figure 1B:
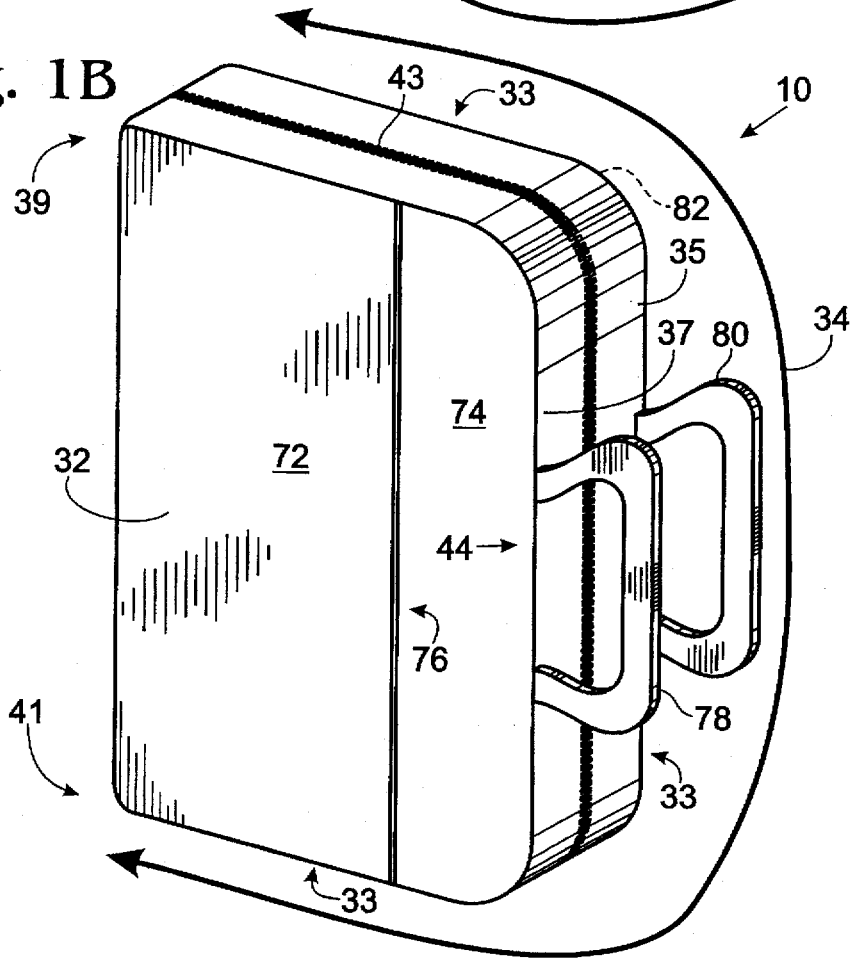
FIG. 1B is a isometric view of the carrying case of FIG. 2A in a closed position.
Figure 2A:
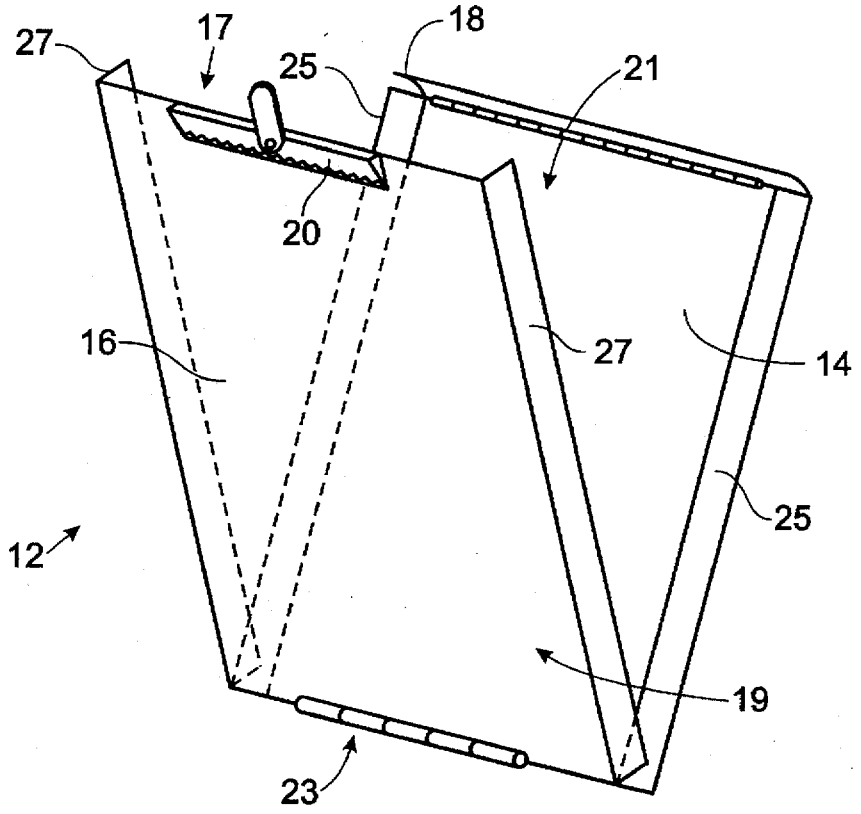
FIG. 2A is a pictorial view of a clip-board for use with the present invention.
Figure 2B:
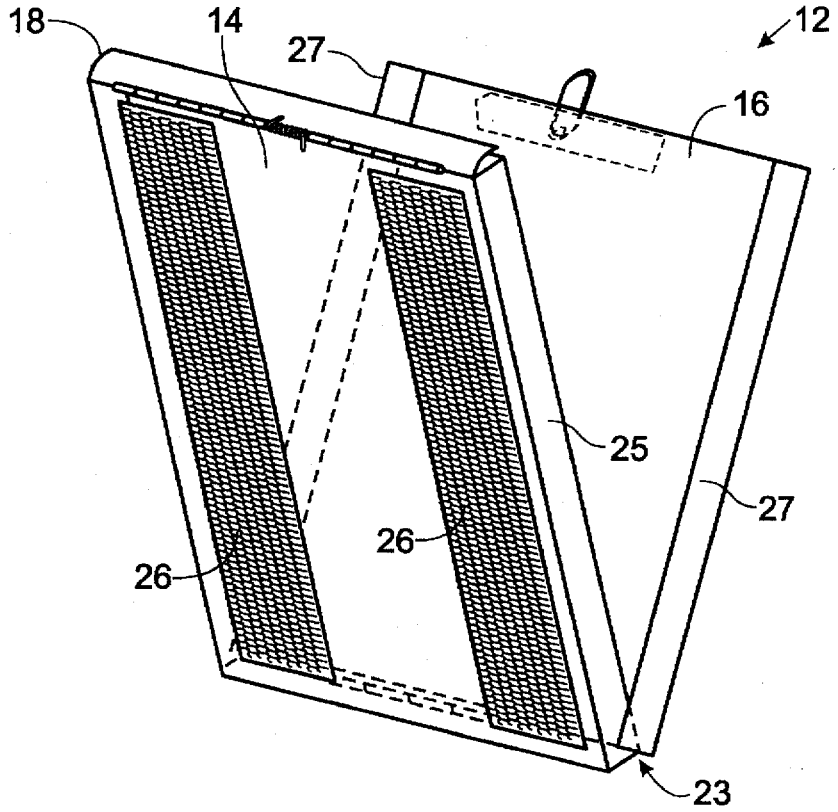
FIG. 2B is a pictorial view of the clip-board of FIG. 1A from the reverse side.

With reference to FIG. 1B, the case 10 may include a pocket 72 on an external surface 74 thereof, the pocket 72 also being substantially rectangular and having an opening 76 facing toward the outside 44 of the case. The case 10 may further include a carrying handle 78, preferably sewn into the intersection of the edge 37 and the external surface 74. A mirror-image carrying handle 80 is preferably likewise attached between edge 35 and an external surface 82 (not shown).

The carrying case 10 is employed by first attaching to the clip-board 12 the fastening members 26. The preferred fastening member 26 may be attached to the preferred clip-board 12 with a self adhesive that is supplied with the fastener. The clip-board 12 may then be installed inside the case 10 on the inside cover 36. A pad of paper 22 adapted for use with the clip-board 12 may be inserted into the first pocket 40 or 54. Other accessories associated with the use of the clip-board may be installed into the other pockets 48, 50, 58, 68 and 70. The openings of all the pockets are advantageously oriented and positioned for easy access thereto.

The case is opened by unsealing the sealed opening 34 and separating the covers 30, 32 in like manner to that of opening a book. The case is closed by reversing this procedure.

It is to be recognized that, while a specific carrying case having a detachable clip-board has been shown as the preferred embodiment of the invention, other configurations could be utilized, in addition to configurations already mentioned, without departing from the principles of the invention.

The terms and expressions which have been employed in the foregoing specification are used therein as terms of description and not of limitation, and there is no intention of the use of such terms and expressions of excluding equivalents of the features shown and described or portions thereof, it being recognized that the scope of the invention is defined and limited only by the claims which follow.

We claim:

1. A carrying case combination for a detachable clip-board, comprising:

a pair of covers having a hinge connection therebetween which permits said covers to swing into open and closed positions, said pair of covers being formed of a substantially water resistant material, one of said covers having on an inside surface thereof a first element of a book and loop fastener, a complementary second element of said hook and loop fastener being attached to a clip-board, said first element cooperating with said complementary second element of said hook and loop fastener to provide a releasable fastening member that affixes the clip-board to said one of said covers when the clip-board is pressed against said inside surface of said one of said covers for removably attaching the clip-board to said inside surface, said open position of said covers defining an opening edge substantially along the perimeter of said covers excluding said hinge connection, wherein portions of said opening edge on each cover include closure members which are sealable together in a closed position.

2. The carrying case of claim 1, wherein said portions of said opening edge comprise substantially the entire length of said opening edge.

3. The carrying case of claim 1, wherein each said portion of said opening edge extends substantially 290 degrees around the perimeter of its respective cover.

4. The carrying case of claim 1, wherein said opening edge includes a zipper for sealing said opening.

5. The carrying case of claim 1, wherein the other of said covers includes a pocket for storing accessory items.

6. The carrying case of claim 5, wherein said pocket has an opening that is angled with respect to an edge of said other cover so that said pocket is shallower nearest said hinge connection and deeper further away.

7. The carrying case of claim 5, wherein said pocket has an opening that faces in a direction substantially perpendicular to that of said hinge connection.

8. The carrying case of claim 5, wherein said pocket has a zippered opening.

9. The carrying case of claim 5, including a flap for covering an opening of and thereby closing said pocket.

10. The carrying case of claim 9, wherein said flap includes a fastening member and wherein said pocket includes a complementary fastening member, for removably fastening said flap to said pocket to cover said opening.

11. The carrying case of claim 1, further comprising a clip-board releasably fastened therein and wherein the clip-board comprises two hingedly connected members which form an enclosure therebetween and a clip adjacent one end of said hingedly connected member.

12. The carrying case of claim 1, further comprising a clip-board and wherein said second element of said hook and loop fastener is attached to said clip-board.

13. A combination carrying case and detachable clip-board, comprising:

a clip-board; and a pair of water resistant covers having a hinge connection therebetween which permits said covers to swing into open and closed positions, the clip-board being removably attached to one of said covers on an inside surface thereof having a first element of a hook and loop fastener cooperating with a complementary second element of the hook and loop fastener for removably attaching the clip-board to said inside surface, said open position defining an opening edge substantially along the perimeter of said covers excluding said hinge connection, wherein portions of said opening edge on each cover include closure members which are sealable together in a closed position.

14. The combination of claim 13, wherein said complementary second element of the hook and loop fastener is attached to the clip-board.

* * * * *